US012421811B2

(12) United States Patent
Pink et al.

(10) Patent No.: US 12,421,811 B2
(45) Date of Patent: Sep. 23, 2025

(54) INSULATED DRILLING SYSTEMS AND ASSOCIATED METHODS

(71) Applicant: National Oilwell Varco, L.P., Houston, TX (US)

(72) Inventors: Tony Pink, Houston, TX (US); Andrei Muradov, Houston, TX (US); Russell Gilleylen, Spring, TX (US); Nooreldin Moussa, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 18/416,671

(22) Filed: Jan. 18, 2024

(65) Prior Publication Data

US 2024/0240530 A1 Jul. 18, 2024

Related U.S. Application Data

(60) Provisional application No. 63/439,758, filed on Jan. 18, 2023.

(51) Int. Cl.
*E21B 17/10* (2006.01)
*E21B 36/00* (2006.01)

(52) U.S. Cl.
CPC ..... *E21B 17/1078* (2013.01); *E21B 36/003* (2013.01)

(58) Field of Classification Search
CPC ..... E21B 17/1078; E21B 36/003
See application file for complete search history.

(56) References Cited

U.S. PATENT DOCUMENTS 3,608,640 A * 9/1971 Willhite ..... E21B 36/003 166/57
4,673,652 A 6/1987 McStravick
(Continued)

FOREIGN PATENT DOCUMENTS

CA 2503394 C * 6/2011 ..... E21B 36/008
CN 113719242 A 11/2021
(Continued)

OTHER PUBLICATIONS

International Search Report and Written Opinion dated Jun. 26, 2024, for Application No. PCT/US2024/012053.
(Continued)

*Primary Examiner* — Aaron L Lembo
(74) *Attorney, Agent, or Firm* — Conley Rose, P.C.

(57) ABSTRACT

An insulated drill pipe joint for a drill string of a well system includes an outer sub defining a central passage extending between a first end of the outer sub and a longitudinally opposed second end of the outer sub, wherein the outer sub includes a first connector located at the first end and a second connector located at the second end, an inner mandrel slidably received in the central passage of the outer sub and defining a central passage extending between a first end of the inner mandrel and a longitudinally opposed second end of the inner mandrel, wherein an annular insulation compartment is formed that at least partially surrounds the inner mandrel and which is sealed from the central passage of the inner mandrel, and an insulation medium located in the insulation compartment and has a greater thermal resistance than the outer sub.

37 Claims, 8 Drawing Sheets

(56) References Cited

U.S. PATENT DOCUMENTS

| | | | | |
|---|---|---|---|---|
| 5,862,866 | A | 1/1999 | Springer | |
| 10,030,094 | B2 * | 7/2018 | Leroy | E21B 36/003 |
| 10,260,666 | B2 * | 4/2019 | Sumner | F16L 53/35 |
| 2005/0103497 | A1 * | 5/2005 | Gondouin | E21B 43/121 166/57 |

FOREIGN PATENT DOCUMENTS

| | | | |
|---|---|---|---|
| CN | 114251055 | A | 3/2022 |
| CN | 114251056 | A | 3/2022 |
| WO | WO-2024231758 | A1 * | 11/2024 |

OTHER PUBLICATIONS

Champness et al: Oil and Natural Gas Technology, "Development and Application of Insulated Drill Pipe for High Temperature, High Pressure Drilling", Final Technical Report, Issued Jan. 2009, Submitted by Drill Cool Systems, Bakersfield, CA, DOE: DE-FC26-06NT42951.

Champness et al: Topical Report, "Preliminary Design of Insulated Drill Pipe for High Temperature, High Pressure Drilling", Report Issued Feb. 1, 2007, Submitted by Drill Cool Systems, Bakersfield, CA, DOE: DE-FC26-06NT42951.

Technology Status Assessment, for Project DE-FC26-NT42951, "Development and Application of Insulated Drill Pipe for High Temperature, High Pressure Drilling", Dec. 2006, Drill Cool Systems, Inc., Bakersfield, CA.

* cited by examiner

INSULATED DRILLING SYSTEMS AND ASSOCIATED METHODS

CROSS-REFERENCE TO RELATED APPLICATIONS

This application claims benefit of U.S. provisional patent application Ser. No. 63/439,758 filed Jan. 18, 2023, and entitled "Insulated Drilling Systems and Associated Methods," which is hereby incorporated herein by reference in its entirety for all purposes.

STATEMENT REGARDING FEDERALLY SPONSORED RESEARCH OR DEVELOPMENT

Not applicable.

BACKGROUND

In drilling a wellbore into an earthen formation, such as for the recovery of geothermal energy as part of a geothermal system, it is typical practice to connect a drill bit onto the lower end of a drill string formed from a plurality of drill pipe joints connected together end-to-end, and then rotate the drill string so that the drill bit progresses downward into the earth to create a wellbore along a predetermined trajectory. In addition to drill pipe joints, the drill string typically includes heavier tubular members known as drill collars positioned between the pipe joints and the drill bit. The drill collars increase the weight applied to the drill bit to enhance its operational effectiveness. Other accessories commonly incorporated into drill strings include stabilizers to assist in maintaining the desired direction of the drilled wellbore, and reamers to ensure that the drilled wellbore is maintained at a desired gauge (i.e., diameter).

SUMMARY

An embodiment of an insulated drill pipe joint for a drill string of a well system comprises an outer sub defining a central passage extending between a first end of the outer sub and a longitudinally opposed second end of the outer sub, wherein the outer sub comprises a first connector located at the first end and a second connector located at the second end, an inner mandrel slidably received in the central passage of the outer sub and defining a central passage extending between a first end of the inner mandrel and a longitudinally opposed second end of the inner mandrel, wherein an annular insulation compartment is formed that at least partially surrounds the inner mandrel and which is sealed from the central passage of the inner mandrel, and an insulation medium located in the insulation compartment and has a greater thermal resistance than the outer sub. In some embodiments, the thermal resistance of the insulation medium is greater than the thermal resistance of the inner mandrel. In some embodiments, the insulation medium comprises a fluid having a pressure that is equal to or less than atmospheric pressure. In some embodiments, the insulation medium comprises a fluid having a pressure that is greater than atmospheric pressure. In certain embodiments, the insulation medium comprises a cylindrical sleeve extending around the inner mandrel. In certain embodiments, wherein the insulation medium comprises a plurality of separate insulation sleeves extending around the inner mandrel. In certain embodiments, the inner mandrel is coupled to the outer sub through frictional contact. In some embodiments, the insulated drill pipe joint comprises a pair of annular seals which seal against an inner surface of the outer sub and an outer surface of the inner mandrel, wherein the annular insulation compartment extends longitudinally between the pair of seals. In some embodiments, the insulated drill pipe joint comprises a pair of centralizers which engage an inner surface of the outer sub and an outer surface of the inner mandrel to position the inner mandrel centrally within the central passage of the outer sub, and wherein the annular insulation compartment is formed that at least partially surrounds the inner mandrel and extends longitudinally between the pair of centralizers. In some embodiments, each of the pair of centralizers comprises a radially inner seal that seals against the outer surface of the inner mandrel and a radially outer seal that seals against the inner surface of the outer sub. In certain embodiments, the insulation medium has a thermal conductivity that is equal to or less than 25 Watts per meter Kelvin (W/mK). In certain embodiments, the insulation medium has a thermal conductivity that is equal to or less than 10 Watts per meter Kelvin (W/mK). In some embodiments, the insulation medium has a thermal conductivity that is equal to or less than 5 Watts per meter Kelvin (W/mK). In some embodiments, the insulation medium has a thermal conductivity that is equal to or less than 1 Watts per meter Kelvin (W/mK).

An embodiment of an insulated drill pipe joint for a drill string of a well system comprises an outer sub defining a central passage extending between a first end of the outer sub and a longitudinally opposed second end of the outer sub, wherein the outer sub comprises a first connector located at the first end and a second connector located at the second end, an inner mandrel slidably received in the central passage of the outer sub and defining a central passage extending between a first end of the inner mandrel and a longitudinally opposed second end of the inner mandrel, a pair of annular seals which seal against an inner surface of the outer sub and an outer surface of the inner mandrel, wherein an annular insulation compartment is formed that at least partially surrounds the inner mandrel and extends longitudinally between the pair of seals, and an insulation medium located in the insulation compartment and comprising an insulation material that has a higher thermal resistance than the outer sub. In some embodiments, the pair of annular seals comprises a pair of elastomeric boots which couples through frictional resistance the inner mandrel to the outer sub. In some embodiments, the insulated drill pipe joint comprises a pair of annular centralizers coupled to the first end and the second end of the inner mandrel to position the inner mandrel centrally within the central passage of the outer sub, wherein the pair of annular seals are positioned on the pair of annular centralizers. In some embodiments, the insulated drill pipe joint comprises a plurality of annular spacers located in the insulation compartment and spaced across the longitudinal length of the inner mandrel. In certain embodiments, each of the spacers has a thermal resistance that is greater than the thermal resistance of the outer sub. In certain embodiments, the radial width of the insulation compartment is equal to or greater than 1.2 millimeters.

An embodiment of an insulated drill pipe joint for a drill string of a well system comprises an outer sub defining a central passage extending between a first end of the outer sub and a longitudinally opposed second end of the outer sub, wherein the outer sub comprises a first connector located at the first end and a second connector located at the second end, an inner mandrel slidably received in the central passage of the outer sub and defining a central passage extending between a first end of the inner mandrel and a longitudinally opposed second end of the inner mandrel, a pair of centralizers which engage an inner surface of the outer sub and an outer surface of the inner mandrel to position the inner mandrel centrally within the central passage of the outer sub, wherein an annular insulation compartment is formed that at least partially surrounds the inner mandrel and extends longitudinally between the pair of centralizers, and an insulation medium located in the insulation compartment and comprising an insulation material that has a higher thermal resistance than the outer sub. In some embodiments, the insulated drill pipe joint comprises a plurality of annular spacers located in the insulation compartment and spaced across the longitudinal length of the inner mandrel. In some embodiments, each of the spacers has a thermal resistance that is greater than the thermal resistance of the outer sub. In certain embodiments, the inner mandrel is coupled to the outer sub through frictional contact. In certain embodiments, at least one of the inner surface of the outer sub and the outer surface of the inner mandrel comprises a thermally resistive coating. In some embodiments, the insulation medium has a thermal conductivity that is equal to or less than 25 Watts per meter Kelvin (W/mK).

An embodiment of a drilling system comprises a drilling rig positioned at the surface, a drillstring extending from the drilling rig into a wellbore penetrating an earthen subterranean formation, wherein the drill string comprises a plurality of insulated drill pipe joints connected end-to-end, and a drill bit coupled to a downhole end of the drill string for drilling into the subterranean formation.

An embodiment of a method for redressing an insulated drill pipe joint for a drill string of a well system comprises (a) removing a portion of a connector of an outer sub of the insulated drill pipe joint whereby a longitudinal length of the connector is reduced; (b) removing a portion of an adjustment sleeve of the insulated drill pipe joint in response to the removal of the portion of the connector of the outer sub whereby a longitudinal length of the adjustment sleeve is reduced; and (c) inserting the adjustment sleeve into a central passage of the outer sub as part of assembling the insulated drill pipe joint. In some embodiments, the length of the portion of the connector removed from the outer sub is equal to the length of the portion of the adjustment sleeve removed therefrom. In some embodiments, the method comprises (d) inserting a pair of centralizers and a mandrel into the central passage of the outer sub such that one of the pair of centralizers is trapped against an internal shoulder of the outer sub while the other of the pair of centralizers is trapped against the adjustment sleeve. In certain embodiments, an annular insulation compartment is formed radially between a radially outer surface of the mandrel and a radially inner surface of the mandrel, the insulation compartment being sealed from a central passage of the mandrel. In certain embodiments, an insulation medium is located in the insulation compartment having a thermal conductivity that is equal to or less than 25 Watts per meter Kelvin (W/mK). In some embodiments, the method comprises (d) removing the adjustment sleeve from the central passage of the outer sub prior to (b).

BRIEF DESCRIPTION OF THE DRAWINGS

For a detailed description of disclosed embodiments, reference will now be made to the accompanying drawings in which.

DETAILED DESCRIPTION

Figure 1:
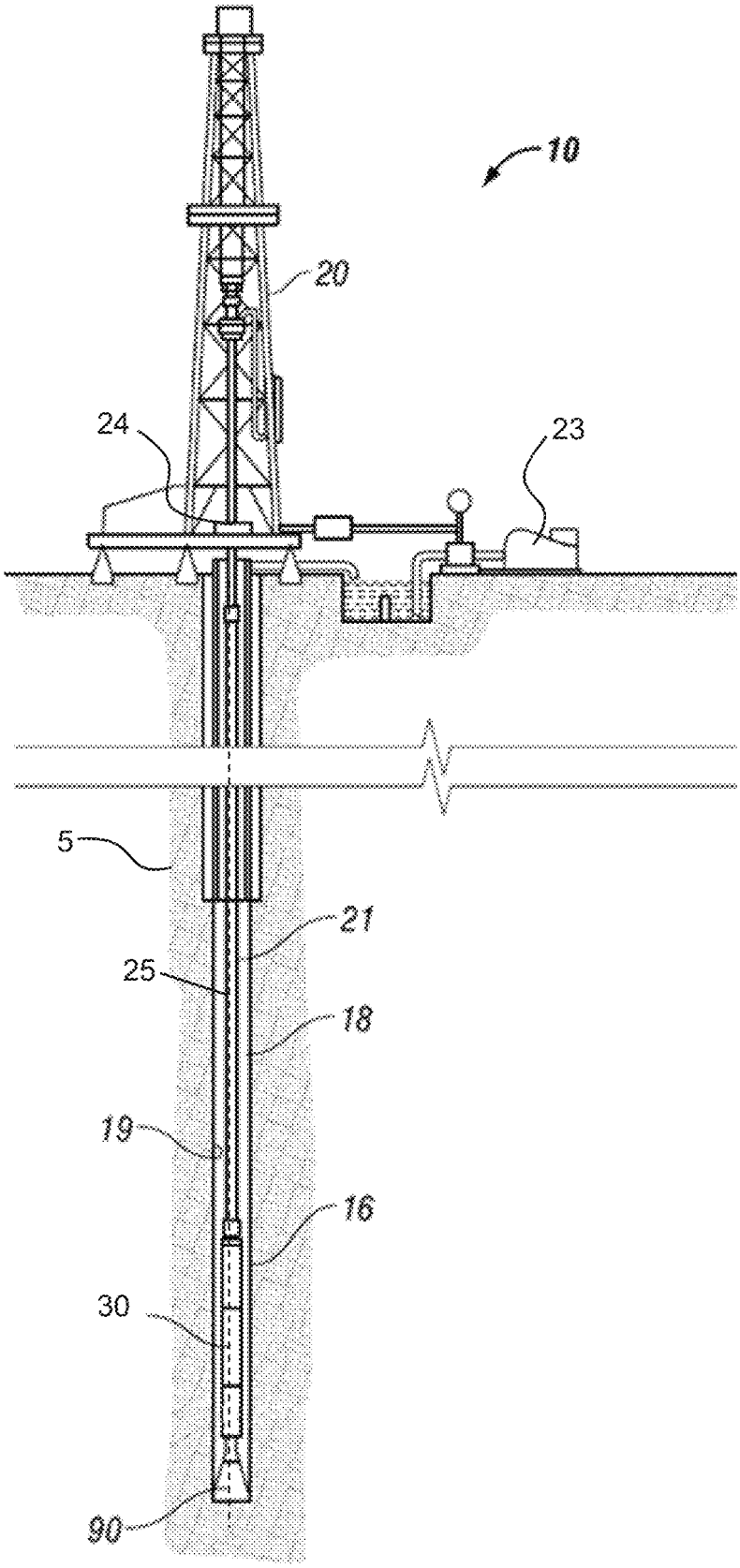
FIG. 1 is a schematic partial cross-sectional view of an embodiment of a drilling system.
Figure 2:
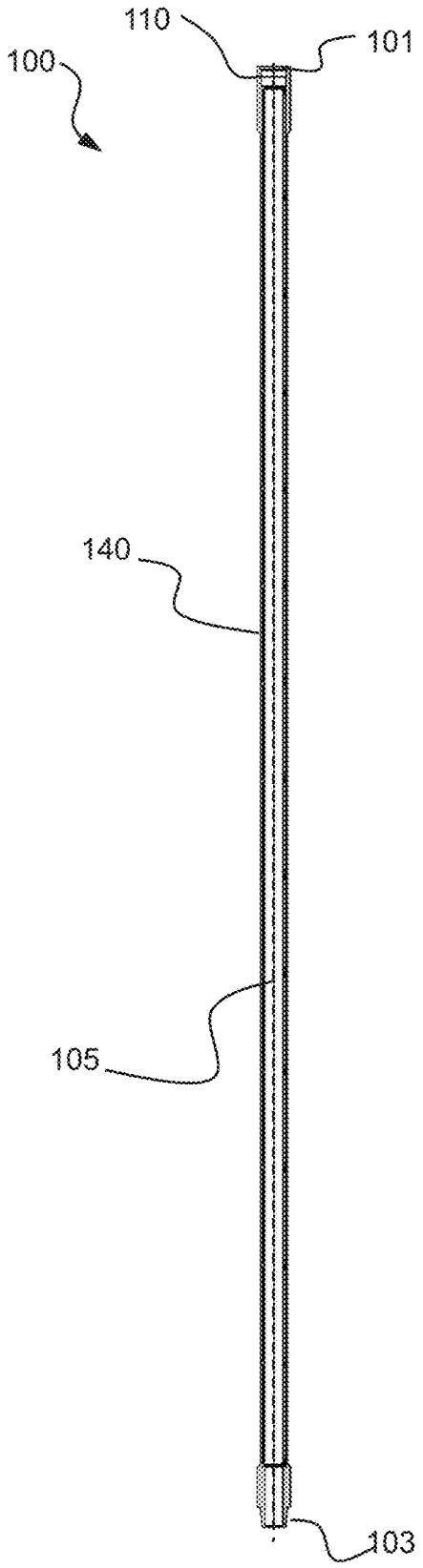
FIG. 2 is a side cross-sectional view of an embodiment of an insulated drill pipe joint.
Figure 3:
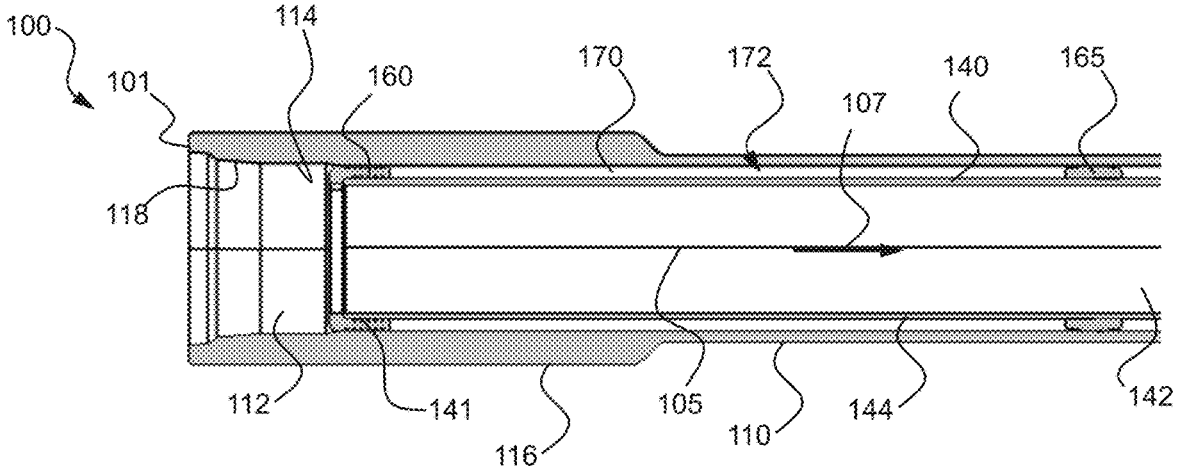
FIG. 3 is a zoomed-in, side cross-sectional view of an uphole section of the insulated drill pipe joint of FIG. 2.
Figure 4:
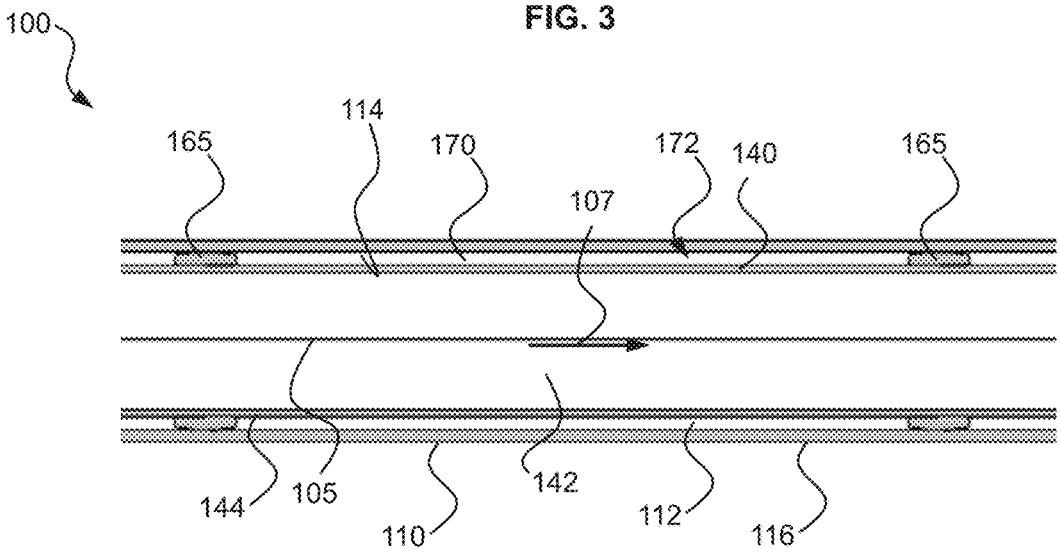
FIG. 4 is a zoomed-in, side cross-sectional view of a central section of the insulated drill pipe joint of FIG. 2.
Figure 5:
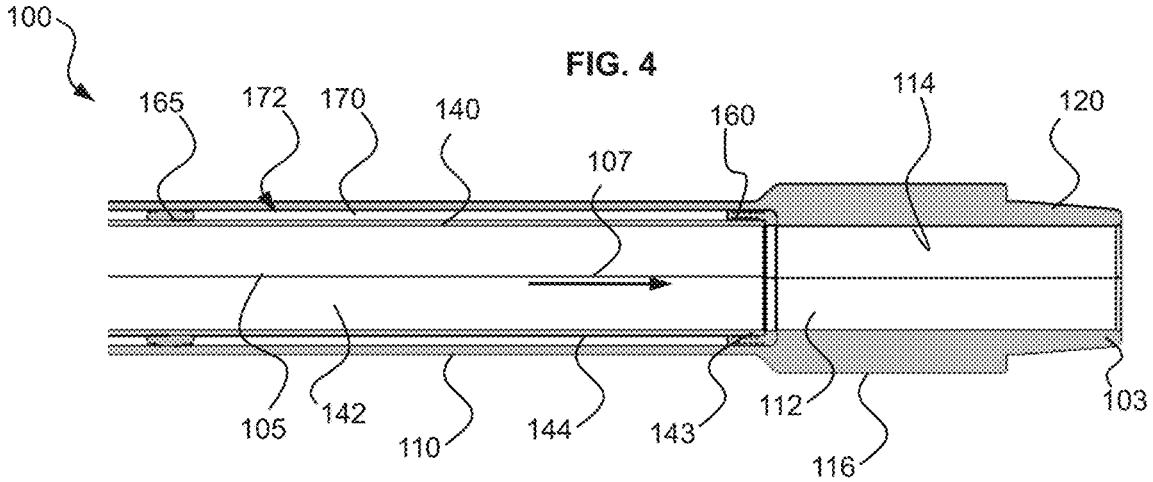
FIG. 5 is a zoomed-in, side cross-sectional view of a downhole section of the insulated drill pipe joint of FIG. 2.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

As described above, it is typical practice to form wellbores in subterranean earthen formations using a drill string having a drill bit connected to an end thereof for a variety of purposes including, for example, the extraction of hydrocarbons and minerals, and the extraction of geothermal energy from the Earth as part of a geothermal system. As but one example, geothermal wells penetrate deeply into the Earth to depths sufficient to heat water conveyed through the geothermal well whereby the water may be converted to steam for driving a surface turbine. Indeed, the ambient temperatures in such wells may reach or exceed 400° C. Heat from the subterranean formation at such significant depths is communicated to the drilling fluid which circulates from the drill bit uphole through the annulus formed between the drill string and BHA (connected therewith) and the surrounding sidewall of the wellbore.

Heat from the subterranean formation may be communicated in-turn from the drilling fluid to components of the drill string and BHA. In some applications, ambient temperatures within the wellbore may be in excess of the operating temperatures of one or more components of the drill string and BHA including, for example, sensors and other electronic equipment of the BHA. In such instances permitting the BHA to substantially reach temperature equilibrium with the ambient conditions of the wellbore or subterranean environment (where the ambient temperature may reach or exceed 175° C. in some applications) may damage or otherwise hinder the performance and reliability of one or more components of the BHA including those components (e.g., measurement-while-drilling (MWD) components) relied on for guiding the trajectory of the BHA through the subterranean formation. While some conventional drilling systems may include surface cooling units or towers for cooling or chilling the drilling fluid entering the uphole end of the drill string at the surface, such conventional surface cooling units may not be equipped for providing adequate cooling to downhole equipment (e.g., electronics of the BHA) in applications in which the wellbore penetrates deeply into the Earth. For example, what cooling a surface cooling or chilling unit may provide may be quickly overwhelmed by the hot conditions of some subterranean environments, particularly in the case of deep or extended reach wellbores such as geothermal wells which may extend for depths of hundreds of meters below the Earth's surface.

Accordingly, embodiments of insulated drill pipe joints for forming insulated drill strings are described herein configured to limit or minimize heat transfer from the subterranean environment to the drilling fluid circulating downhole through the insulated drill string and into the subterranean environment. Instead of (or in conjunction with) surface cooling the drilling fluid, the insulated drill strings disclosed herein shield the drilling fluid from the heat of the subterranean environment as the drilling fluid circulates downhole through the drill string and into the wellbore. In this manner, the insulated drill string, in mitigating heat transfer from the subterranean environment to the drilling fluid circulating therethrough, permits the relatively cool drilling fluid discharged from the downhole end of the insulated drill string to cool sensitive components of the BHA connected therewith, such as sensors and electronic equipment of the BHA which otherwise could potentially overheat and malfunction within the hot subterranean environment. The insulation provided by the insulated drill strings disclosed herein may assist in maintaining the temperature of sensitive downhole equipment within their respective operational ranges even in deep or extended reach wells such as geothermal wells having particularly hot and inhospitable subterranean environments.

As will be discussed further herein, embodiments of insulated drill pipe joints include an outer sub defining a central passage extending between a first end of the outer sub and a longitudinally opposed second end of the outer sub, wherein the outer sub comprises a first connector located at the first end and a second connector located at the second end. Additionally, embodiments of insulated drill pipe joints disclosed herein include an inner mandrel slidably received in the central passage of the outer sub and defining a central passage extending between a first end of the inner mandrel and a longitudinally opposed second end of the inner mandrel. The inner mandrel may couple to the outer sub through frictional contact so as to isolate the inner mandrel from external, longitudinally directed tensile or compressive loads applied to the outer sub, such as loads transferred from adjacent insulated drill pipe joints coupled to the given insulated drill pipe joint. In this configuration, an annular insulation compartment is formed that at least partially surrounds the inner mandrel and which is sealed from the central passage of the inner mandrel, and an insulation medium located in the insulation compartment and has a greater thermal resistance than the outer sub. The insulation compartment containing the insulation medium therein minimizes heat transfer between drilling fluid circulating downhole through the insulated drill pipe joint and the hot subterranean environment surrounding the insulated drill pipe joint, permitting the shielded drilling fluid to adequately cool sensitive components of the BHA attached to the drill string, such as sensitive MWD sensors and other electronic equipment of the BHA which cannot be exposed to excessive temperatures without jeopardizing the performance or reliability of the sensitive equipment.

Referring to FIG. 1, an embodiment of a well or drilling system 10 is shown. Well system 10 is generally configured for drilling a wellbore 16 in an earthen formation 5. In this exemplary embodiment, well system 10 includes a drilling rig 20 disposed at the surface, an insulated drill string 21 extending downhole from rig 20, a bottomhole assembly (BHA) 30 coupled to the downhole end of insulated drill string 21, and a drill bit 90 attached to the lower end of BHA 30. A surface or mud pump 23 is positioned at the surface and pumps drilling fluid or mud through insulated drill string 21. Additionally, rig 20 includes a rotary system 24 for imparting torque to an upper end of insulated drill string 21 to thereby rotate insulated drill string 21 in wellbore 16. In this exemplary embodiment, rotary system 24 comprises a rotary table located at a rig floor of rig 20; however, in other embodiments, rotary system 24 may comprise other systems for imparting rotary motion to insulated drill string 21, such as a top drive.

In this exemplary embodiment, a downhole mud motor is provided in BHA 30 for facilitating the drilling of deviated portions of wellbore 16. The downhole mud motor of BHA 30 may include a hydraulic drive or power section coupled to a bearing assembly. In some embodiments, the portion of BHA 30 can include other components, such as drill collars, measurement-while-drilling (MWD) tools, reamers, stabilizers and the like. It may be understood that in other embodiments well system 10 may not include BHA 30 and instead the downhole end of the insulated drill string 21 may connect directly to the drill bit 90.

In this exemplary embodiment, the downhole mud motor of BHA 30 converts the fluid pressure of the drilling fluid pumped downward through insulated drill string 21 into rotational torque for driving the rotation of drill bit 90. With force or weight applied to the drill bit 90, also referred to as weight-on-bit ("WOB"), the rotating drill bit 90 engages the earthen formation and proceeds to form wellbore 16 along a predetermined path toward a target zone. The drilling fluid or mud pumped down the insulated drill string 21 and through BHA 30 passes out of the face of drill bit 90 and back up the annulus 18 formed between insulated drill string 21 and the wall 19 of wellbore 16. The drilling fluid cools the bit 90, and flushes the cuttings away from the face of bit 90 and carries the cuttings to the surface.

Referring to FIGS. 2-5, an embodiment of an insulated drill pipe joint 100 is shown. It may be understood that in some embodiments the drill pipe joints of system 10 may be configured similarly as insulated drill pipe joint 100, while in other embodiments the configuration of drill pipe joints may vary from the configuration of insulated drill pipe joint 100. Drill pipe joint 100 has a central or longitudinal axis 105 and generally includes a first or uphole end 101, a second or downhole end 103 longitudinally opposite uphole end 101, a tubular outer sub 110 extending longitudinally between ends 101 and 103, and a tubular inner casing or mandrel 140 slidably received in the outer sub 110 and also extending longitudinally between ends 101 and 103.

In this exemplary embodiment, outer sub 110 extends longitudinally between a first or uphole end that defines the uphole end 101 of insulated drill pipe joint 100, and a second or downhole end that similarly defines the downhole end 103 of insulated drill pipe joint 100. Uphole end 101 and downhole end 103 may thus also be referred to herein as the uphole end 101 of outer sub 110 and the downhole end 103 of outer sub 110. Additionally, outer sub 110 generally includes a central bore or passage 112 defined by a generally cylindrical inner surface 114 extending longitudinally between ends 101 and 103, and a generally cylindrical outer surface 116 extending longitudinally between ends 101 and 103. Outer sub 110 comprises a single, integrally or monolithically formed sub in this exemplary embodiment, but it may be understood that outer sub 110 may comprise a plurality of separate outer subs connected end-to-end. Additionally, the outer sub 110 may be formed from a variety of materials, including various metallic materials and alloys.

A first or uphole connector 118 is formed on the outer surface 116 in this exemplary embodiment at the downhole end 103 thereof while a second or downhole connector 120 is formed on the inner surface 114 at the uphole end 101 thereof. In this exemplary embodiment, uphole connector 118 comprises a threaded "box" connector while the downhole connector 120 comprises a threaded "pin" connector. In some embodiments, connectors 118 and 120 may comprise rotary shouldered threaded connections (RSTCs); however, it may be understood that the configuration of connectors 118 and/or 120 may vary in other embodiments. The uphole connector 118 of outer sub 110 may threadably or otherwise connect to the downhole end 103 of an adjacent insulated drill pipe joint 100 (not shown in FIGS. 2-5). Similarly, the downhole connector 120 of outer sub 110 may threadably or otherwise connect to the uphole end 101 of an adjacent insulated drill pipe joint 100 (not shown in FIGS. 2-5).

The inner mandrel 140 of insulated drill pipe joint 100 generally includes a first or uphole end 141, a second or downhole end 143 longitudinally opposite uphole end 141, a central bore or passage 142 extending longitudinally between ends 141 and 143, and a generally cylindrical outer surface 144 extending longitudinally between ends 141 and 143. As will be described further herein, in this exemplary embodiment, inner mandrel 140 is coupled or secured to the outer sub 110 through frictional contact. Additionally, the inner mandrel 140 may be formed from a variety of materials, including materials similar to those comprising outer sub 110. The inner mandrel 140 has a longitudinal length extending between ends 141 and 143 that is less than the longitudinal length of the outer sub 110 extending between ends 101 and 103. In certain embodiments, the longitudinal length of inner mandrel 140 is approximately 75% or greater of the longitudinal length of outer sub 110. In some embodiments, the longitudinal length of inner mandrel 140 is approximately 80% or greater of the longitudinal length of outer sub 110. In some embodiments, the longitudinal length of inner mandrel 140 is approximately 85% or greater of the longitudinal length of outer sub 110.

Inner mandrel 140 is secured within the central passage 112 of outer sub 110 whereby relative movement between the outer sub 110 and inner mandrel 140 is restricted. Particularly, in this exemplary embodiment, the insulated drill pipe joint 100 includes a pair of annular or generally ring-shaped boots 160 coupled to the uphole and downhole ends 141 and 143, respectively, of the inner mandrel 140. In this exemplary embodiment, boots 160 fit over the respective ends 141 and 143, respectively, of inner mandrel 140 whereby boots 160 are secured to the ends 141 and 143 of inner mandrel 140. In some embodiments, boots 160 each comprise an elastomeric or rubber material that may be stretched over the ends 141 and 143 of inner mandrel 140. Additionally, the pair of boots 160 press against the inner surface 114 of outer sub 110 when inner mandrel 140 is received within the outer sub 110, where friction between boots 160 and the inner surface 114 of outer sub 110 at least assists in locking the inner mandrel 140 to the outer sub 110. The frictional contact between boots 160 and the outer sub 110 and inner mandrel 140 resists relative movement between outer sub 110 and inner mandrel 140 while permitting external loads applied to the outer sub 110 (e.g., longitudinally directed compressive or tensile loads applied to outer sub 110 by another insulated drill pipe joint 100 connected therewith) to bypass the inner mandrel 140 without similarly subjecting the inner mandrel 140 to the application of the external load.

Additionally, in this exemplary embodiment, insulated drill pipe 100 also includes one or more annular or ring-shaped mandrel spacers 165 spaced along the longitudinal length of inner mandrel 140 longitudinally between the pair of boots 160. Mandrel spacers 165 may be spaced apart at regular intervals (e.g., every five feet, every ten feet, every fifteen ft, every twenty feet) along the longitudinal length of inner mandrel 140. In some embodiments, insulated drill pipe 100 may include boots 160 but not mandrel spacers 165 while in other embodiments insulated drill pipe 100 may include one or more of the mandrel spacers 165 but not the boots 160. Mandrel spacers 165 may each also be formed from an elastomeric material, rubber, or alternative materials that, in a manner similar to boots 160, frictionally couples to both the outer surface 144 of inner mandrel 140 and the inner surface 114 of outer sub 110.

In this exemplary embodiment, boots 160 and mandrel spacers 165 comprise materials having a high thermal resistance to minimize heat transfer between inner mandrel 140 and the outer sub 110. For example, boots 160 and mandrel spacers 165 may comprise elastomeric materials, rubbers, plastics, polymers, metals, fiberglass, fiber and resin-based materials. Indeed, in some embodiments, inner mandrel 140 does not directly contact outer sub 110 and instead the inner mandrel 140 couples to the outer sub 110 entirely through the boots 160 and mandrel spacers 165, minimizing direct heat transfer between the inner mandrel 140 and the outer sub 110. Additionally, boots 160 sealingly engage both the outer surface 144 of inner mandrel 140 and the inner surface 114 of outer sub 110. In some embodiments, one or more of the mandrel spacers 165 may also sealingly engage both the outer surface 144 of inner mandrel 140 and the inner surface 114 of outer sub 110. Sealing engagement between the pair of boots 160 and the outer sub 110 and inner mandrel 140 defines an annular insulation compartment or chamber 170 which extends longitudinally from a first or uphole boot 160 of the pair of boots 160 and a second or downhole boot 160 of the pair of boots 160.

The insulation compartment 170 of insulated drill pipe joint 100 is filled with an insulation medium 172 configured to minimize the amount of heat transfer that occurs across the insulation compartment 170 (e.g., between outer sub 110 and inner mandrel 140 across the insulation compartment 170). The insulation medium 172 has a thermal resistance that is greater than the thermal resistance of either outer sub 110 or inner mandrel 140. In some embodiments, the thermal conductivity (sometimes referred to as the "K-factor" or "K-value") of insulation medium 172 is approximately less than 25 Watts per meter Kelvin (W/mK). In some embodiments, the thermal conductivity of insulation medium 172 is approximately less than 10 W/mK. In certain embodiments, the thermal conductivity of insulation medium 172 is approximately less than 5 W/mK. In certain embodiments, the thermal conductivity of insulation medium 172 is approximately less than 1 W/mK. In some embodiments, the thermal conductivity of insulation medium 172 is approximately less than 0.5 W/mK. In some embodiments, the thermal conductivity of insulation medium 172 is approximately less than 0.1 W/mK. It may be understood that the thermal conductivity of insulation medium 172 may be selected based on the requirements of the given application.

The insulation medium 172 may comprise a liquid, gas, solid, or multi-phase material. Additionally, the insulation medium 172 may be homogeneous or may comprise plurality of separate or discrete components. In this exemplary embodiment, insulation medium 172 comprises air at atmospheric pressure which may be less than the pressure of the drilling fluid (indicated by arrow 107 in FIGS. 3-5) which circulates downhole through the central passage 142 of the inner mandrel 140 of insulated drill pipe joint 100 when joint 100 is operated as part of a drill string. In some embodiments, the insulation medium 172 may comprise a gas or other fluid that has been placed under a vacuum that is less than atmospheric pressure. For example, in certain embodiments, insulation medium 172 may comprise a fluid having a pressure of, for example, 15 pounds per square inch (PSI) or less, 10 PSI or less, and 5 PSI or less.

In some embodiments, insulation medium 172 has a radial thickness that is equal to or greater than approximately 1.2 millimeters (mm). In some embodiments, the insulation medium 172 has a radial thickness that is equal to or greater than approximately 2 mm. In some embodiments, the insulation medium 172 has a radial thickness that is equal to or greater than 5 mm. In certain embodiments, the insulation medium 172 has a radial thickness that is equal to or greater than 10 mm. As with the thermal conductivity of insulation medium 172, it may be understood that the radial thickness of insulation medium 172 may be selected based on the requirements of the given application.

In this configuration, heat from the surrounding wellbore (not shown in FIGS. 2-5) external insulated drill pipe joint 100 must generally travel across the insulation compartment 170 of pipe joint 100 whereby the insulation medium 172 located therein may minimize the amount of heat transferred to the inner mandrel 140 and drilling fluid 107 conveyed therein, successfully insulating the drilling fluid 107 from the heat of the surrounding wellbore. Additionally, while heat may flow directly through the outer sub 110 to the drilling fluid 107 flowing therethrough at the longitudinal ends 101 and 103 of outer sub 110, it may be understood that ends 101 and 103 define thick-walled sections of outer sub 110 having a radial thickness that is greater than the thickness of the section of outer sub 110 extending between the pair of thick-walled end sections of outer sub 110.

In some embodiments, various surfaces of insulated drill pipe joint 100 are at least partially coated with a thermally resistive coating such as ceramic coatings and others having a low thermal conductivity (e.g., a thermal conductivity less than 1 W/mK). Particularly, in this exemplary embodiment, the inner surface 114 of outer sub 110 is at least partially defined by a thermally resistive coating and the outer surface 144 of inner mandrel 140 is similarly at least partially be defined by a thermally resistive coating to minimize heat transfer radially across the insulation compartment 170 of insulated drill pipe joint 100. The thermally resistive coating applied to the inner surface 114 of outer sub 110 may assist in reducing heat transfer at the longitudinal ends 101 and 103 of outer sub 110. Additionally, in some embodiments, the inner surface of inner mandrel 140 defining central passage 142 may at least partially be defined by a thermally resistive coating. However, it may be understood that in other exemplary embodiments the inner surface 114 of outer sub 110 and/or the outer surface 144 of inner mandrel 140 may not comprise or otherwise be defined by a thermally resistive coating.

Figure 6:
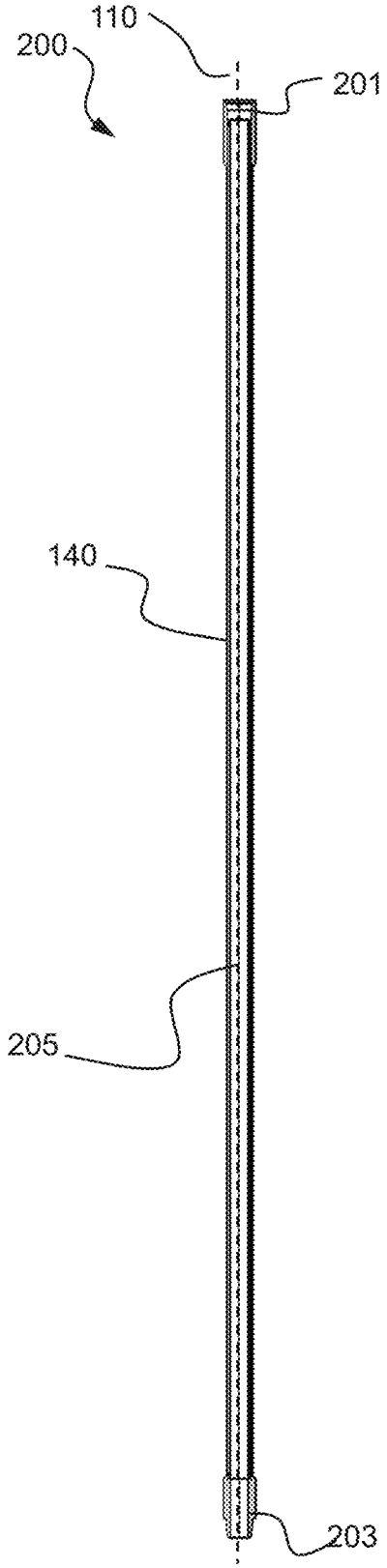
FIG. 6 is a side cross-sectional view of an embodiment of an insulated drill pipe joint.
Figure 7:
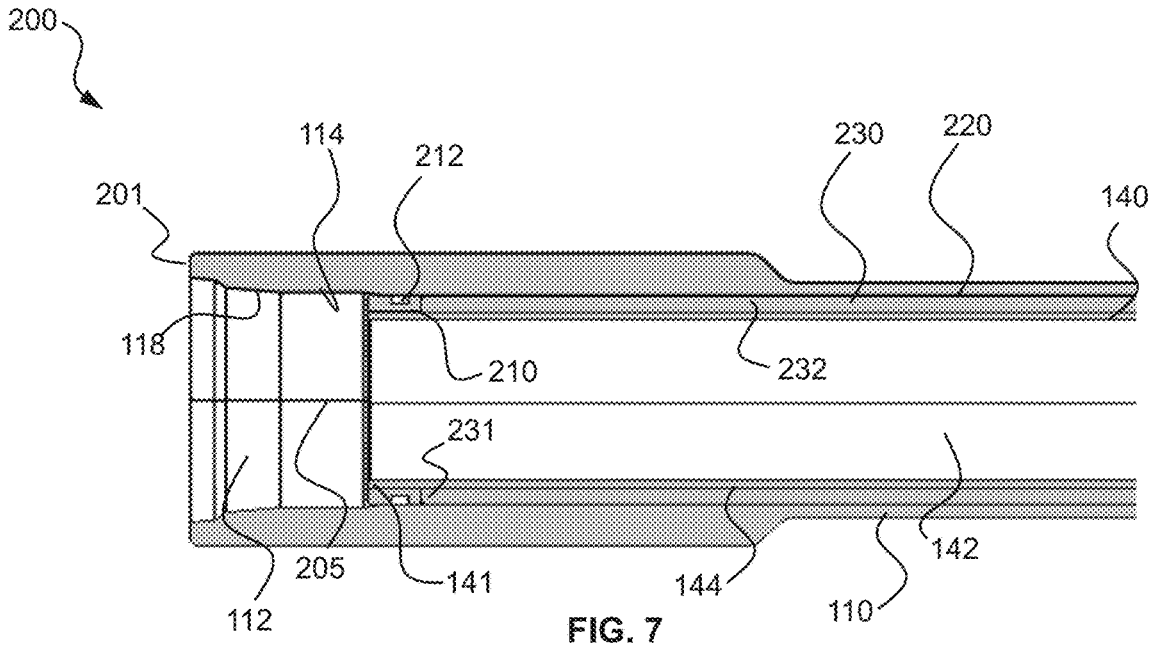
FIG. 7 is a zoomed-in, side cross-sectional view of an uphole section of the insulated drill pipe joint of FIG. 6.
Figure 8:
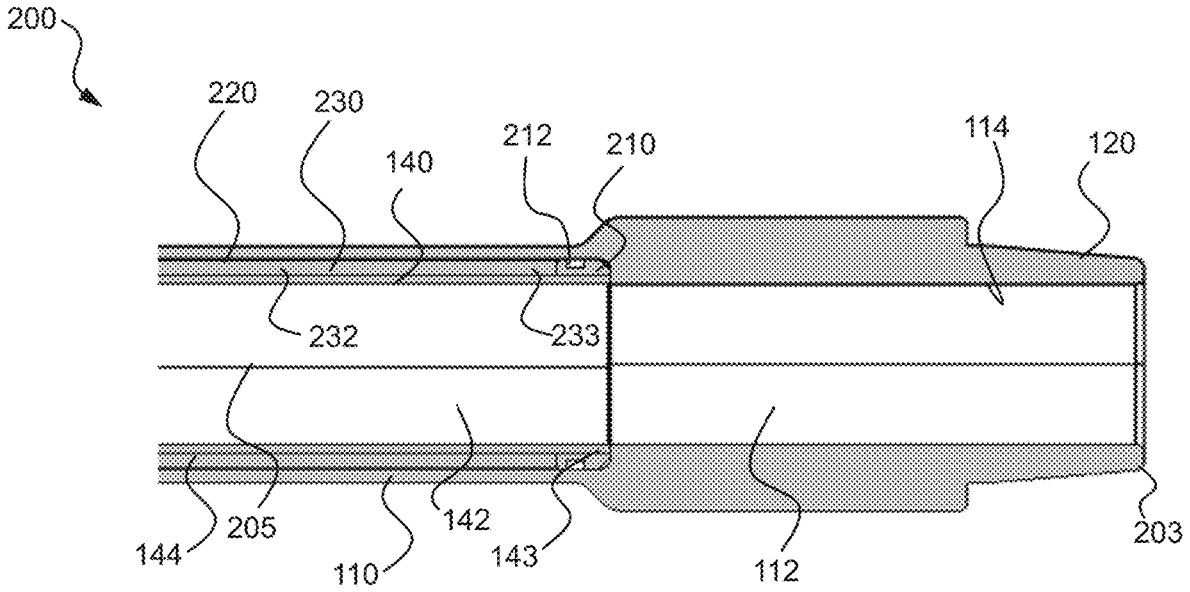
FIG. 8 is a zoomed-in, side cross-sectional view of a downhole section of the insulated drill pipe joint of FIG. 6.

Referring to FIGS. 6-8, another embodiment of an insulated drill pipe joint 200 is shown. It may be understood that in some embodiments the drill pipe joints of system 10 may be configured similarly as insulated drill pipe joint 200, while in other embodiments the configuration of drill pipe joints may vary from the configuration of insulated drill pipe joint 200. Additionally, insulated drill pipe joint 200 includes features in common with the insulated drill pipe joint 100 shown in FIGS. 2-5, and shared features are labeled similarly.

Particularly, drill pipe joint 200 has a central or longitudinal axis 205 and generally includes a first or uphole end 201, a second or downhole end 203 longitudinally opposite uphole end 201, outer sub 110 extending longitudinally between ends 201 and 203, and the inner mandrel 140 received in the outer sub 110. Additionally, in this exemplary embodiment, instead of boots 160, insulated drill pipe joint 200 includes a pair of annular or generally ring-shaped hubs or centralizers 210 coupled to the opposing ends 141 and 143 of the inner mandrel 140. In this exemplary embodiment, centralizers 210 are coupled to the outer surface 144 of inner mandrel 140 at the opposing ends 141 and 143 thereof. For example, centralizers 210 may be welded, threadably coupled, or otherwise secured to inner mandrel 140 to restrict relative movement between inner mandrel 140 and centralizers 210.

Centralizers 210 may comprise a metallic material or alloy, and may comprise a similar material as either the outer sub 110 and/or the inner mandrel 140 of insulated drill pipe joint 200. Centralizers 210 assist in centralizing the position of inner mandrel 140 within the central passage 112 of outer sub 110 whereby any angle between a longitudinal or central axis of inner mandrel 140 and a longitudinal or central axis of outer sub 110 is minimized or eliminated. In this manner, centralizers 210 may provide an annular insulation compartment 220 of insulated drill pipe joint 200, which extends longitudinally between the pair of centralizers 210, with a substantially consistent radial thickness along the longitudinal length of the insulation compartment 220. Additionally, in this exemplary embodiment, an annular seal assembly 212 is positioned along a radially outer surface of each centralizer 210. Seal assemblies 212 seal against the inner surface 114 of outer sub 110 to seal the insulation compartment 220 from the remainder of the central passage 112 of outer sub 110. Each seal assembly 212 may include an elastomeric seal such as an O-ring seal, but it may be understood that the configuration of seal assemblies 212 may vary in other embodiments.

In this exemplary embodiment, insulated drill pipe 200 includes an annular insulation medium 230 located in the insulation compartment 220 to reduce or minimize the heat transfer that may occur radially across the insulation compartment 220. Particularly, in this exemplary embodiment, insulation medium 230 comprises a solid cylindrical body or sleeve 232 formed from a thermal insulating material and extending between a pair of longitudinally opposed ends 231 and 233, respectively. In some embodiments, sleeve 232 comprises an elastomeric or rubber material while in other embodiments sleeve 232 may comprise fiberglass or other materials having a relatively high thermal resistance (e.g., greater than the thermal resistance of outer sub 110 and inner mandrel 140).

Figure 9:
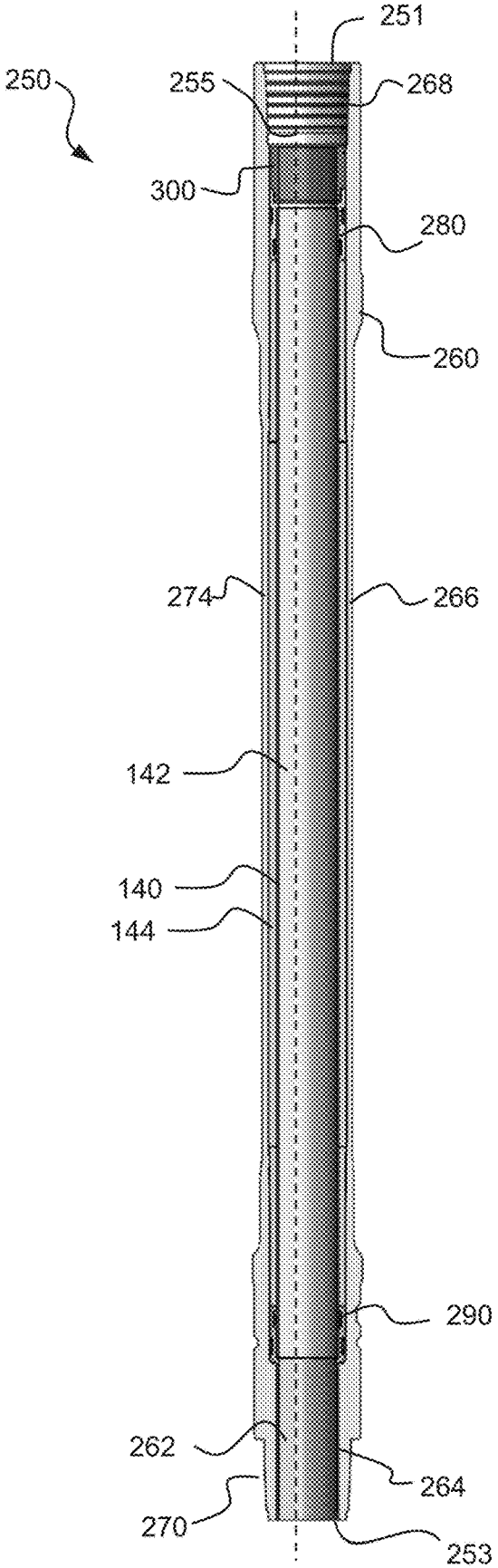
FIG. 9 is a side cross-sectional view of an embodiment of an insulated drill pipe joint.
Figure 10:
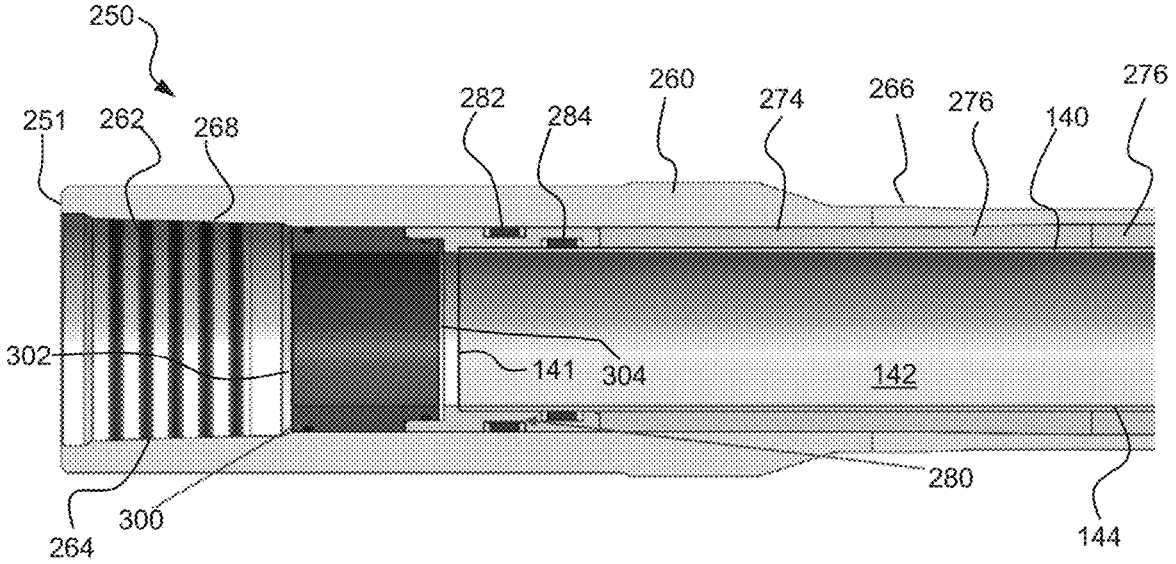
FIG. 10 is a zoomed-in, side cross-sectional view of an uphole section of the insulated drill pipe joint of FIG. 9.
Figure 11:
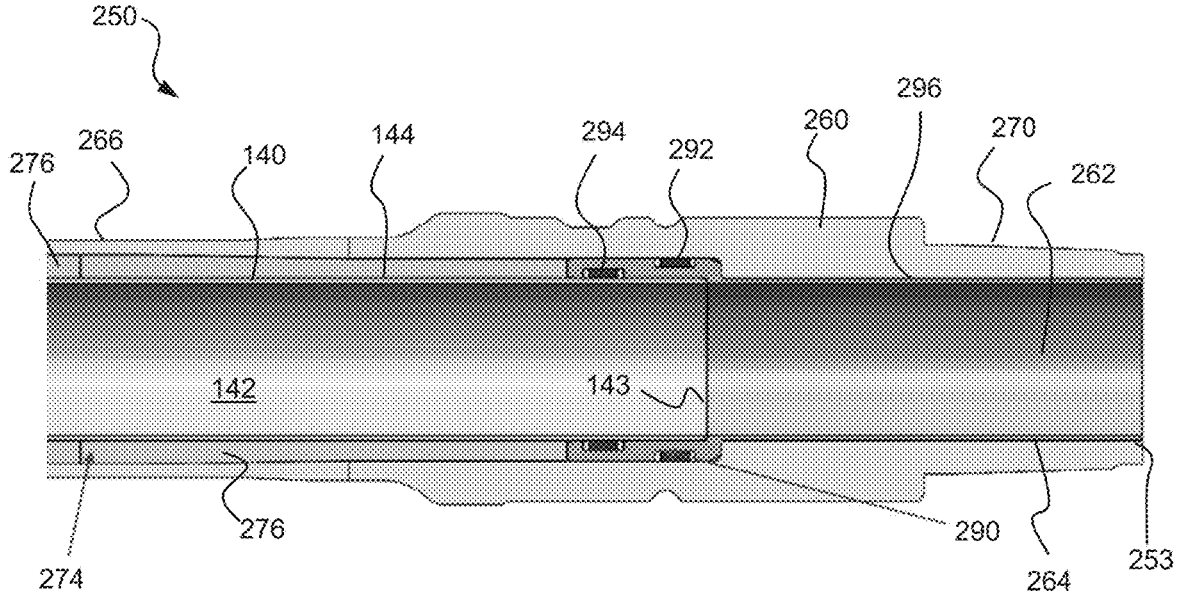
FIG. 11 is a zoomed-in, side cross-sectional view of a downhole section of the insulated drill pipe joint of FIG. 9.

Referring to FIGS. 9-11, another embodiment of an insulated drill pipe joint 250 is shown. It may be understood that in some embodiments the drill pipe joints of system 10 may be configured similarly as insulated drill pipe joint 250, while in other embodiments the configuration of drill pipe joints may vary from the configuration of insulated drill pipe joint 250. Additionally, insulated drill pipe joint 250 includes features in common with the insulated drill pipe joint 250 shown in FIGS. 2-5 and/or drill pipe joint 200 show in FIGS. 6-8, and shared features are labeled similarly.

Particularly, drill pipe joint 250 has a central or longitudinal axis 255 and generally includes a first or uphole end 251, a second or downhole end 253 longitudinally opposite uphole end 251, a tubular outer sub 260 extending longitudinally between ends 251 and 253, mandrel 140 slidably received in the outer sub 260, a pair of annular or generally ring-shaped hubs or centralizers 280 and 290 coupled to the opposing ends 141 and 143 of the inner mandrel 140, respectively, and an adjustment sleeve 300 also received within the outer sub 260.

Outer sub 260 of insulated drill pipe joint 250 generally includes a central bore or passage 262 defined by a generally cylindrical inner surface 264 extending longitudinally between ends 251 and 253, and a generally cylindrical outer surface 266 extending longitudinally between ends 251 and 253. A first or uphole connector 268 (e.g., a threaded box connector configured to form a RSTC) is formed on the inner surface 264 in this exemplary embodiment at the uphole end 251 thereof while a second or downhole connector 270 (e.g., a threaded pin connector configured to form a RSTC) is formed on the outer surface 266 at the downhole end 253 thereof. The uphole connector 268 of outer sub 260 may threadably or otherwise connect to the downhole end 253 of an adjacent insulated drill pipe joint 250 while the downhole connector 270 of outer sub 260 may similarly threadably or otherwise connect to the uphole end 251 of an adjacent insulated drill pipe joint 250.

Inner mandrel 140 is secured within the central passage 262 of outer sub 260 by the pair of centralizers 280 and 290 whereby relative movement between the outer sub 260 and inner mandrel 140 is restricted. In this exemplary embodiment, centralizers 280 and 290 are coupled to the outer surface 144 of inner mandrel 140 at the opposing ends 141 and 143 thereof. For example, centralizers 280 and 290 may be welded, threadably coupled, or otherwise secured to inner mandrel 140 to restrict relative movement between inner mandrel 140 and centralizers 280 and 290.

Centralizers 280 and 290 may comprise a metallic material or alloy, and may comprise a similar material as either the outer sub 260 and/or the inner mandrel 140 of insulated drill pipe joint 250. Centralizers 280 and 290 assist in centralizing the position of inner mandrel 140 within the central passage 262 of outer sub 260 whereby any angle between a longitudinal or central axis of inner mandrel 140 and a longitudinal or central axis of outer sub 260 is minimized or eliminated. In addition, centralizers 280 and 290 seal the opposing ends 141 and 143 of mandrel 140 whereby an annular, sealed insulation compartment 274 of insulated drill pipe joint 250 is formed that extends longitudinally between the pair of centralizers 280 and 290.

Particularly, in this exemplary embodiment, a first or uphole centralizer 280 includes a radially outer annular seal assembly 282 (e.g., positioned along a radially outer surface of the uphole centralizer 280) that seals against the inner surface 264 of outer sub 260 and a corresponding radially inner annular seal assembly 284 (e.g., positioned along a radially inner surface of the uphole centralizer 280) that seals against the outer surface 144 of mandrel 140. Similarly, a second or downhole centralizer 290 includes a radially outer annular seal assembly 292 (e.g., positioned along a radially outer surface of the downhole centralizer 290) that seals against the inner surface 264 of outer sub 260 and a corresponding radially inner annular seal assembly 294 (e.g., positioned along a radially inner surface of the downhole centralizer 290) that seals against the outer surface 144 of mandrel 140. In this manner, seal assemblies 282 and 284 of uphole centralizer 280 cooperate to seal an uphole end of insulation compartment 274 while seal assemblies 292 and 294 of downhole centralizer 290 cooperate to seal a downhole end of insulation compartment 274. Each seal assembly 282, 284, 292 and 294 may include an elastomeric seal such as an O-ring seal, but it may be understood that the configuration of seal assemblies 282, 284, 292, and 294 may vary in other embodiments.

In this exemplary embodiment, the downhole centralizer 290 includes a cylindrical liner 296 positioned along an inner diameter of centralizer 290 and which extends through the downhole connector 270 of outer sub 260, terminating proximal the downhole end 253 of insulated drill pipe joint 250. In this manner, liner 296 defines a downhole end of the downhole centralizer 290. The liner 296 of downhole centralizer 290 assists in centralizing the downhole centralizer 290 relative to the outer sub 260 (e.g., whereby central axes of liner 296 and sub 260 are aligned) and disassembly of the insulated drill pipe joint 250.

By sealing each opposing longitudinal end of insulation compartment 274, the pressure of insulation compartment 274 may be adjusted independently of the pressure within the central passage 142 of mandrel 140/central passage 262 of outer sub 260. For example, pressure within insulation compartment 274 may be minimized at the surface prior to deployment of the insulation drill pipe joint 250 downhole such that a vacuum is formed within insulation compartment 274 to assist in minimizing heat transfer radially across the insulation compartment 274. Alternatively, a desired elevated pressure may be maintained within the insulation compartment 274 to prevent internal pressure within mandrel 140 from expanding or ballooning the mandrel 140 radially outwards which could negatively impact the reliability of the insulated drill pipe joint 250 and prevent the joint 250 from being used in relatively deep/high-pressure environments. Thus, in some embodiments, a predefined pressure is maintained within the insulation compartment 274 that may be less than, equal to, or greater than pressure within the central passage 142 of mandrel 140.

In addition, in this exemplary embodiment, insulation compartment 274 is filled with an insulation medium comprising a plurality of separate insulation sleeves or rings 276 that are stacked or positioned end-to-end from the uphole end of insulation compartment 274 to the downhole end of insulation compartment 274. In this manner, insulation sleeves 276 are trapped between the pair of centralizers 280 and 290 and are sealed from the environment exterior insulation compartment 274 including the central passage 142 of mandrel 140. Insulation sleeves 276 may comprise a variety of thermally insulating materials (e.g., rubber). In some embodiments, the longitudinal length of insulation compartment 274 may be only partially filled with insulation sleeves 276. In certain embodiments, the different insulation sleeves 276 forming the insulation medium of compartment 276 may have varying mechanical and/or thermal properties such that the mechanical and/or thermal (e.g., thermal insulating) properties of insulation compartment 274 may be turned or varied along its longitudinal length.

In this exemplary embodiment, the downhole centralizer 290 comprises a radially outer external shoulder that engages a corresponding radially inner shoulder of the outer sub 260 formed along the inner surface 264. In addition, the downhole centralizer 290 comprises a radially inner internal shoulder that engages the downhole end 143 of mandrel 140. Further, the uphole stabilizer 280 comprises a first or lower radially inner internal shoulder that engages the uphole end 141 of mandrel 140. In this configuration, mandrel 140 is mechanically trapped between the pair of centralizers 280 and 290. However, an uphole end of the uphole centralizer 280 is not trapped against a corresponding internal shoulder of outer sub 260 (such as is the case with downhole centralizer 290). Instead, the uphole end of uphole centralizer 280 engages a downhole end 304 of the adjustment sleeve 300 that is slidably disposed in the central passage 262 of outer sub 260 to restrict relative movement between an assembly formed from centralizers 280, 290 and mandrel 140 and the outer sub 260.

Particularly, in this exemplary embodiment, adjustment sleeve 300 has a predefined axial length extending between opposing longitudinal ends 302 and 304 that is configured to fill the remaining longitudinal space extending uphole from the uphole centralizer 280 within the central passage 262 of outer sub 260 (referred to herein as the "dead space" of the central passage 262) such that, when a first insulated drill pipe joint 250 is assembled with other insulated drill pipe joints 250 as part of a drillstring, a downhole end of the downhole connector 270 of a second insulated drill pipe joint 250 (positioned directly adjacent and uphole from the first insulated drill pipe joint 250) contacts or engages the uphole end 302 of the adjustment sleeve 300 of the first insulated drill pipe joint 250 to restrict relative movement between the outer sub 260 of the first insulated drill pipe joint 250 and an assembly of the first insulated drill pipe joint 250 including the adjustment sleeve 300, centralizers 280 and 290, and mandrel 140. Thus, in this exemplary embodiment, the downhole connector 270 of the second insulated drill pipe joint 250 serves to mechanically trap the uphole centralizer 280 of the first insulated drill pipe joint 250 into position instead of the outer sub 260 of the first insulated drill pipe joint 250.

The predefined length of the adjustment sleeve 300 of a given insulated drill pipe joint 250 may be based on a longitudinal length of the uphole connector 268 of the insulated drill pipe joint 250 to ensure the adjustment sleeve 300 will become trapped within the outer sub 260 of the joint 250 following assembly of the joint 250 with an adjacent insulated drill pipe joint 250 whereby internal, longitudinal "play" of the adjustment sleeve 300 (and other internal components of the insulated drill pipe joint 250) is substantially reduced or eliminated. In some embodiments, adjustment sleeve 300 may be adjusted in response to adjustments in length of the uphole connector 268 of the insulated drill pipe joint 250.

For example, following deployment in a wellbore as part of a drillstring, part of the uphole connector 268 may become damaged necessitating that a portion of the uphole connector 268 be removed or cut off to remediate said damage and thereby make the insulated drill pipe joint 250 ready for future use. In some embodiments, the adjustment sleeve 300 may be adjusted in response to the adjustment of the uphole connector 268 whereby the longitudinal length of the adjustment sleeve 300 is decreased by an equivalent amount as the longitudinal length of the uphole connector 268. In this manner, following the adjustment to the longitudinal length of uphole connector 268 (e.g., as part of remediating damage to the uphole connector 268), the adjusted (e.g., decreased) longitudinal length of the adjustment sleeve 300 will adequately fill the remaining dead space within the central passage 262 of outer sub 260 while also not interfering with the threaded connection formed between the modified uphole connector 268 of the given insulated drill pipe joint 250 and an adjoining insulated drill pipe joint 250 coupled to the modified uphole connector 268. In other words, the longitudinal length of the adjustment sleeve 300 may be modified or adjusted to reflect or mirror the modification or adjustment to the longitudinal length of the uphole connector 268 to ensure internal components of the insulated drill pipe joint 250 are prevented from moving longitudinally within the outer sub 260 thereof once joint 250 has been connected with other insulated drill pipe joint 250 to form a drillstring.

Figure 12:
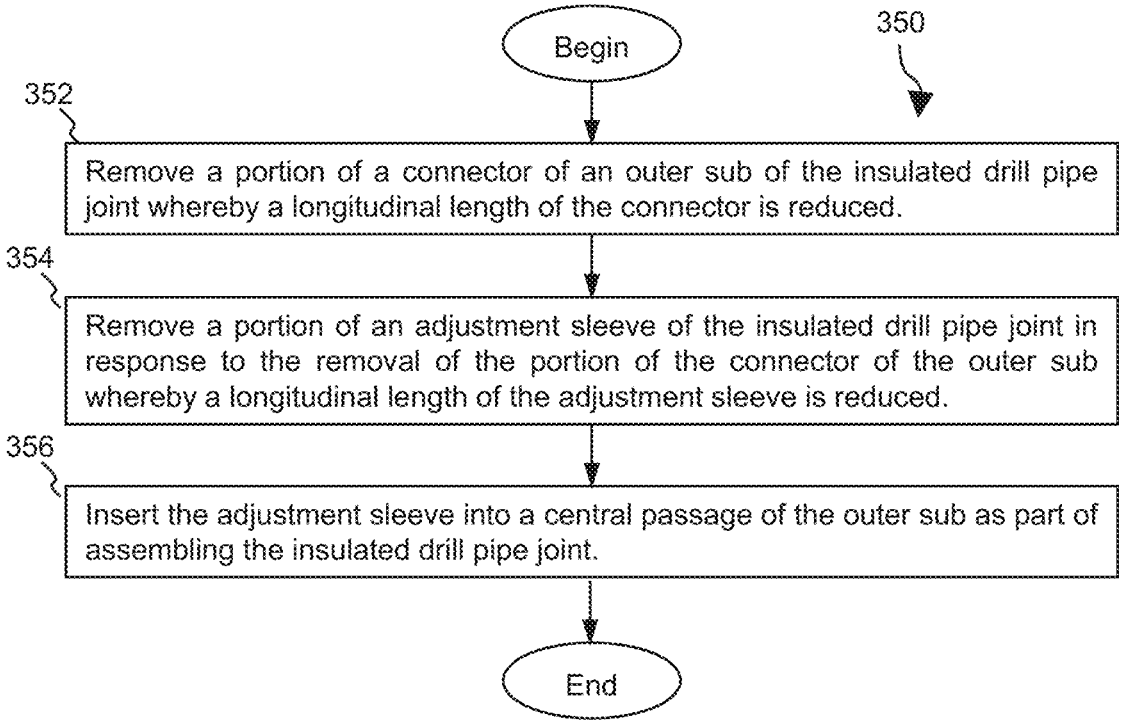
FIG. 12 is a block diagram of an embodiment of a method for redressing an insulated drill pipe joint for a drill string of a well system.

Referring now to FIG. 12, a method 350 for redressing an insulated drill pipe joint (e.g., insulated drill pipe joint 100 shown in FIGS. 2-5, insulated drill pipe joint 200 shown in FIGS. 6-8, and insulated drill pipe joint 250 shown in FIGS. 9-11) for a drill string of a well system (e.g., well system 10 shown in FIG. 1) is shown. Beginning at block 352, method 350 comprises removing (e.g., cutting) a portion (e.g., from a longitudinal end) of a connector (e.g., uphole connector 268 shown in FIGS. 9 and 10) of an outer sub (e.g., outer sub 260 shown in FIGS. 9-11) of the insulated drill pipe joint whereby a longitudinal length of the connector is reduced.

At block 354, method 350 comprises removing (e.g., cutting) a portion (e.g., from a longitudinal end) of an adjustment sleeve (e.g., adjustment sleeve 300 shown in FIGS. 9 and 10) of the insulated drill pipe joint in response to the removal of the portion of the connector of the outer sub whereby a longitudinal length of the adjustment sleeve is reduced. At block 356, method 350 comprises inserting the adjustment sleeve into a central passage (e.g., central passage 262 of outer sub 260) of the outer sub as part of assembling the insulated drill pipe joint.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An insulated drill pipe joint for a drill string of a well system, the insulated drill pipe joint comprising:

an outer sub comprising an inner surface defining a central passage extending between a first end of the outer sub and a longitudinally opposed second end of the outer sub, wherein the outer sub comprises a first connector located at the first end and a second connector located at the second end;

an inner mandrel slidably received in the central passage of the outer sub and defining a central passage extending between a first end of the inner mandrel and a longitudinally opposed second end of the inner mandrel, wherein both the first end and the second end of the inner mandrel are both radially and longitudinally spaced from the inner surface of the outer sub, and wherein an annular insulation compartment is formed that at least partially surrounds the inner mandrel and which is sealed from the central passage of the inner mandrel; and an insulation medium located in the insulation compartment and has a greater thermal resistance than the outer sub.

2. The insulated drill pipe joint of claim 1, wherein the thermal resistance of the insulation medium is greater than the thermal resistance of the inner mandrel.

3. The insulated drill pipe joint of claim 1, wherein the insulation medium comprises a fluid having a pressure that is equal to or less than atmospheric pressure.

4. The insulated drill pipe joint of claim 1, wherein the insulation medium comprises a fluid having a pressure that is greater than atmospheric pressure.

5. The insulated drill pipe joint of claim 1, wherein the insulation medium comprises a cylindrical sleeve extending around the inner mandrel.

6. The insulated drill pipe joint of claim 1, wherein the insulation medium comprises a plurality of separate insulation sleeves extending around the inner mandrel.

7. The insulated drill pipe joint of claim 1, wherein the inner mandrel is coupled to the outer sub through frictional contact.

8. The insulated drill pipe joint of claim 1, further comprising a pair of annular seals which seal against the inner surface of the outer sub and an outer surface of the inner mandrel, wherein the annular insulation compartment extends longitudinally between the pair of seals.

9. The insulated drill pipe joint of claim 1, further comprising a pair of centralizers which engage the inner surface of the outer sub and an outer surface of the inner mandrel to position the inner mandrel centrally within the central passage of the outer sub, and wherein the annular insulation compartment is formed that at least partially surrounds the inner mandrel and extends longitudinally between the pair of centralizers.

10. The insulated drill pipe joint of claim 9, wherein each of the pair of centralizers comprises a radially inner seal that seals against the outer surface of the inner mandrel and a radially outer seal that seals against the inner surface of the outer sub.

11. The insulated drill pipe joint of claim 1, wherein the insulation medium has a thermal conductivity that is equal to or less than 25 Watts per meter Kelvin (W/mK).

12. The insulated drill pipe joint of claim 1, wherein the insulation medium has a thermal conductivity that is equal to or less than 10 Watts per meter Kelvin (W/mK).

13. The insulated drill pipe joint of claim 1, wherein the insulation medium has a thermal conductivity that is equal to or less than 5 Watts per meter Kelvin (W/mK).

14. The insulated drill pipe joint of claim 1, wherein the insulation medium has a thermal conductivity that is equal to or less than 1 Watts per meter Kelvin (W/mK).

15. An insulated drill pipe joint for a drill string of a well system, the insulated drill pipe joint comprising:

an outer sub defining a central passage extending between a first end of the outer sub and a longitudinally opposed second end of the outer sub, wherein the outer sub comprises a first connector located at the first end and a second connector located at the second end;

an inner mandrel slidably received in the central passage of the outer sub and defining a central passage extending between a first end of the inner mandrel and a longitudinally opposed second end of the inner mandrel;

a pair of annular seals which seal against an inner surface of the outer sub and an outer surface of the inner mandrel, wherein an annular insulation compartment is formed that at least partially surrounds the inner mandrel and extends longitudinally between the pair of seals; and an insulation medium located in the insulation compartment and comprising an insulation material that has a higher thermal resistance than the outer sub.

16. The insulated drill pipe joint of claim 15, wherein the pair of annular seals comprises a pair of elastomeric boots which couples through frictional resistance the inner mandrel to the outer sub.

17. The insulated drill pipe joint of claim 15, further comprising a pair of annular centralizers coupled to the first end and the second end of the inner mandrel to position the inner mandrel centrally within the central passage of the outer sub, wherein the pair of annular seals are positioned on the pair of annular centralizers.

18. The insulated drill pipe joint of claim 15, further comprising a plurality of annular spacers located in the insulation compartment and spaced across the longitudinal length of the inner mandrel.

19. The insulated drill pipe joint of claim 18, wherein each of the spacers has a thermal resistance that is greater than the thermal resistance of the outer sub.

20. The insulated drill pipe joint of claim 15, wherein the radial width of the insulation compartment is equal to or greater than 1.2 millimeters.

21. The insulated drill pipe joint of claim 15, wherein the pair of annular seals prevent contact between the outer sub and the inner mandrel to inhibit direct heat transfer between the inner mandrel and the outer sub.

22. The insulated drill pipe joint of claim 15, wherein the pair of annular seals define opposing terminal ends of the insulation compartment.

23. An insulated drill pipe joint for a drill string of a well system, the insulated drill pipe joint comprising:

an outer sub defining a central passage extending between a first end of the outer sub and a longitudinally opposed second end of the outer sub, wherein the outer sub comprises a first connector located at the first end and a second connector located at the second end;

an inner mandrel slidably received in the central passage of the outer sub and defining a central passage extending between a first end of the inner mandrel and a longitudinally opposed second end of the inner mandrel;

a pair of centralizers which engage an inner surface of the outer sub and an outer surface of the inner mandrel to position the inner mandrel centrally within the central passage of the outer sub, wherein an annular insulation compartment is formed that at least partially surrounds the inner mandrel and extends longitudinally between the pair of centralizers; and an insulation medium located in the insulation compartment and comprising an insulation material that has a higher thermal resistance than the outer sub.

24. The insulated drill pipe joint of claim 23, further comprising a plurality of annular spacers located in the insulation compartment and spaced across the longitudinal length of the inner mandrel.

25. The insulated drill pipe joint of claim 24, wherein each of the spacers has a thermal resistance that is greater than the thermal resistance of the outer sub.

26. The insulated drill pipe joint of claim 23, wherein the inner mandrel is coupled to the outer sub through frictional contact.

27. The insulated drill pipe joint of claim 23, wherein at least one of the inner surface of the outer sub and the outer surface of the inner mandrel comprises a thermally resistive coating.

28. The insulated drill pipe joint of claim 23, wherein the insulation medium has a thermal conductivity that is equal to or less than 25 Watts per meter Kelvin (W/mK).

29. A drilling system, comprising:

a drilling rig positioned at a surface;

a drillstring extending from the drilling rig into a wellbore penetrating an earthen subterranean formation, wherein the drill string comprises a plurality of the insulated drill pipe joints of claim 21 connected end-to-end; and a drill bit coupled to a downhole end of the drill string for drilling into the subterranean formation.

30. The insulated drill pipe joint of claim 23, wherein the pair of centralizers prevent contact between the outer sub and the inner mandrel to inhibit direct heat transfer between the inner mandrel and the outer sub.

31. The insulated drill pipe joint of claim 23, wherein the pair of centralizers define opposing terminal ends of the insulation compartment.

32. A method for redressing an insulated drill pipe joint for a drill string of a well system, the method comprising:

(a) removing a portion of a connector of an outer sub of the insulated drill pipe joint whereby a longitudinal length of the connector is reduced;

(b) removing a portion of an adjustment sleeve of the insulated drill pipe joint in response to the removal of the portion of the connector of the outer sub whereby a longitudinal length of the adjustment sleeve is reduced; and (c) inserting the adjustment sleeve into a central passage of the outer sub as part of assembling the insulated drill pipe joint.

33. The method of claim 32, wherein the length of the portion of the connector removed from the outer sub is equal to the length of the portion of the adjustment sleeve removed therefrom.

34. The method of claim 32, further comprising:

(d) inserting a pair of centralizers and a mandrel into the central passage of the outer sub such that one of the pair of centralizers is trapped against an internal shoulder of the outer sub while the other of the pair of centralizers is trapped against the adjustment sleeve.

35. The method of claim 34, wherein an annular insulation compartment is formed radially between a radially outer surface of the mandrel and a radially inner surface of the mandrel, the insulation compartment being sealed from a central passage of the mandrel.

36. The method of claim 35, wherein an insulation medium is located in the insulation compartment having a thermal conductivity that is equal to or less than 25 Watts per meter Kelvin (W/mK).

37. The method of claim 32, further comprising:

(d) removing the adjustment sleeve from the central passage of the outer sub prior to (b).

* * * * *